US006305056B1

(12) United States Patent
Hübner

(10) Patent No.: US 6,305,056 B1
(45) Date of Patent: Oct. 23, 2001

(54) DEVICE FOR ADJUSTING THE WIDTH OF THE WAISTBAND OF A SKIRT OR A PAIR OF TROUSERS

(76) Inventor: Thomas Hübner, Schlossergasse 4, D-97900 Uissigheim (DE)

( * ) Notice: Subject to any disclaimer, the term of this patent is extended or adjusted under 35 U.S.C. 154(b) by 0 days.

(21) Appl. No.: 09/424,830

(22) PCT Filed: May 27, 1998

(86) PCT No.: PCT/DE98/01454

§ 371 Date: Dec. 21, 1999

§ 102(e) Date: Dec. 21, 1999

(87) PCT Pub. No.: WO98/53716

PCT Pub. Date: Dec. 3, 1998

(30) Foreign Application Priority Data

May 27, 1997 (DE) ..... 297 09 261 U

(51) Int. Cl.[7] ..... A41F 9/02

(52) U.S. Cl. ..... 24/545; 24/200; 24/199

(58) Field of Search ..... 24/184, 164, 545, 24/68 PP, 68 D, 685 B, 71, 1, 68 BT, 910, DIG. 28, 308, 199, 200; 2/312

(56) References Cited

U.S. PATENT DOCUMENTS 2,229,003 * 1/1941 Fly ..... 24/200
2,849,773 * 9/1958 Kaselow ..... 24/200
2,984,879 * 5/1961 Budd et al. ..... 24/199
5,566,427 10/1996 Lathrop .
5,600,875 * 2/1997 Chang ..... 24/200

FOREIGN PATENT DOCUMENTS

100919 A 8/1923 (CH) .
295 15 386 U 1/1996 (DE) .

* cited by examiner

*Primary Examiner*—Robert J. Sandy
(74) *Attorney, Agent, or Firm*—Edwin D. Schindler

(57) ABSTRACT

An apparatus for adjusting the width of the waistband of a skirt or a pair of trousers, includes a U-shaped clip which slides onto the waistband perpendicularly to the longitudinal direction of the waistband. The U-shaped clip has two limbs which are interconnected on the top sides thereof and which run substantially parallel to each other. The waistband is arranged in a fold formed by the waist band passing by the clip, substantially parallel thereto, first to one limb of the clip. The waistband loops around the first limb before running back in an opposite direction, between the two limbs of the clip, to the second limb. The waistband further loops around the second limb before finally being guided back in the opposite direction. Each side of the clip is also provided with an arm which extends vertically. The arms are provided near the plane defined by the clip and fit on a respective outer flank of the fold on a side facing away from the U-shaped clip.

18 Claims, 2 Drawing Sheets

DEVICE FOR ADJUSTING THE WIDTH OF THE WAISTBAND OF A SKIRT OR A PAIR OF TROUSERS

BACKGROUND OF THE INVENTION

1. Technical Field of the Invention

The invention concerns a device for adjusting the width of the waistband of a skirt or a pair of trousers. The inventive device has a U-shaped clip which slides on to the waistband perpendicularly to the longitudinal direction of said waistband. Said clip consists of two limbs. Said limbs are interconnected on the top side and run essentially parallel to each other. The waistband is arranged in a fold.

2. Description of the Prior Art

Such devices are known, for instance, from the German patent 221 474. This patent discloses a waistband that is guided through the limbs of the clip in a fold and is affixed inside the garment by means of a clamp. It is foreseen to attach the clip to the garment. This allows the flexible adjustment of the width of a waistband. The disadvantage thereby is that the clamped fold can move over time owing to the movements of the person wearing the trousers or skirt, or the waistband becomes threadbare over time at the point of clamping. Moreover, the clamp is located entirely inside the waistband and can be unpleasantly bulky. Furthermore, the fold of the waistband is visible externally, which is rather negative in appearance. By virtue of the fact that the clip is to be attached to the garment it cannot be used for a variety of trousers or skirts.

SUMMARY OF THE INVENTION

By way of contrast the invention has the object of providing a device of this generic concept which essentially functions without a clamping effect, is not unpleasantly bulky inside the waistband, can be used on a variety of trousers and skirts and an arising fold is not visible externally, if necessary.

This task is solved therein that the fold is formed in that said waistband passes by the clip, essentially parallel thereto, first to one limb of the clip. The waistband loops around said first limb before running back in the opposite direction, between the two limbs of the clip, to the other limb. It loops around said second limb before being finally guided back in the opposite direction. Each side of the clip is also provided with an arm which extends vertically. Said arms are provided near the plane defined by the clip and fit on the respective outside flank of the fold on the side facing away from the clip.

The position of the plane defined by the clip depends essentially on the shape of the clip. If, for example, the limbs of the clips are pins that extend vertically, it is a plane in which the U-shape lies. By way of contrast, if the limbs are parallel plates, which are aligned perpendicularly to the plane defined by the U, a plane, which is defined by the clip, extends parallel to the plates. The outside flanks of the fold are the pieces in which the waistband runs away from the limbs of the clips and as a rule on the outside of the clip. In any case the clip should fit so that the waistband is arranged on the segments, on which it runs away from the clip, essentially parallel to the plane defined by the clip.

The clip is fitted on to the waistband so that one limb is located inside and the other limb outside. It is then turned on the waistband about a vertical axis until the waistband is arranged in the form of the fold described. To prevent the clip from turning back, it must be affixed in relation to the waistband. The clip does not require a clamping effect, and only one of the arms must be disposed inside the waistband, between the waistband and the waist. To that end, the arms can be disposed on the clip, in particular integrally moulded or provided on an element that is separated from the clip. For instance, one arm can be one of the two limbs of a clasp. Here one limb encompasses an outside flank and the other limb is affixed, if necessary, to the clip or to a waistband piece. The two arms can also be fitted to one single clasp if, for example, they encompass the two outside flanks as arms directed downwards from the top side of the clip.

However, preferred is the use of a holder which contains the two arms and encompasses the clip, including the fold, on both sides of the plane defined by the clip. The outside flanks of the fold are guided out of the holder on opposing sides. The shape of the holder should be such that the clip with fold inside cannot be rotated about a vertical axis. Such a holder not only holds the outside flanks proximate to the clip plane but also covers the clip, which perhaps does not look particularly attractive, and the fold of the waistband. The outside surfaces of the holder can be accordingly designed in optical terms. The holder can then be fitted, for example, by sliding it on to the clip from above.

To enable the variable adjustment of the width, more than two limbs can also be fitted to the clip. Different pairs of limbs can then define different planes of the clip. Depending on the desired shortening, the corresponding limbs are selected and the clip affixed correspondingly twisted. If necessary, the waistband can also loop around more than two of the limbs of the clip. An inventive device wears especially well if several limbs are disposed approximately in one plane. The extension of the clip perpendicularly to the waistband is then relatively small so that the device is less bulky.

Preferred, however, is the disposal of the limbs on two plates that extend parallel to each other. The U-shape of the clip is yielded here perpendicularly to the plates. The waistband runs first on the exterior side of one plate, then loops around a limb of this plate and is guided into the interior space between the plates, runs there along in the opposite direction a way, in turn loops around a limb of the other plate and finally is guided in the opposite direction along the other plate. In order that the waistband can loop around the lateral limitation of a plate, the lateral limitation lines of the plates should as far as possible extend vertically. One plate respectively can be formed by one or more limbs, which are spaced apart from one another respectively by a vertical slot. For shortening, the clip is placed on to the waistband so that the waistband is enclosed by the two plates, and twists on a vertical axis about 180°.

The waistband can only be shorted variably if at least one of the plates comprises a plurality of limbs. A relatively large shortening of the waistband is achieved if it is guided along the plates across their entire extension. A lesser shortening is obtained if the waistband is guided through a slot of the plate instead of around the exterior side of the plate. The clip is fitted thereto so that the waistband runs on a piece between the two plates and is guided out of the interior space on one side through a slot. After turning around a vertical axis by 180° in the corresponding direction, one obtains the desired result. Turning by 180° in the opposing direction results in a greater shortening of the waistband.

Preferably both plates are subdivided, which also makes the clip lighter. As far as possible, the limbs are disposed on the plates so as to be equidistant, for the device is simple to handle if the waistband can be shortened or extended at the same distances in relation to any position. If all limbs are of the same length, the clip can be designed with a minimum vertical extension.

A clip which is formed by two plates is preferably affixed in the way described via a holder. Such a holder can be composed of two shell surfaces connected on the top side. In order that the clip, including the fold, of the waistband find room inside the holder, the interior distance between the shell surfaces should be greater across a length, which corresponds at feast to the extension of the plates in the longitudinal direction of the waistband, than the extension of the clip perpendicularly to the plates plus twice the thickness of the waistband disposed on the exterior sides of the plates. The extension of the holder in the direction perpendicularly to the waistband can be smaller if the shell surfaces are disposed essentially parallel to each other. To affix the clip inside the holder, the interior distance between the plates should be smaller than a diagonal between the plates in a horizontal cutting plane, that is, so that a clip cannot be turned in the holder, even without closely fitting waistband stretches. Between the exterior edges of the two shell surfaces, there should remain respectively a slot-shaped aperture, which extends essentially vertically, through which the waistband is guided outwards.

To prevent the holder from moving along the waistband, in particular so that the clip at some stage is no longer enclosed by the holder, the distance between the shell surfaces toward the apertures should decrease, at least section-wise. To ensure that, the width of the apertures is preferably smaller than the distance between the exterior sides of the two plates. The holder can then, independently also of the thickness of the waistband, no longer slide away laterally across the clip.

A holder wears most pleasantly if the shell surface located inside the waistband is essentially plate-shaped. The thickness of the shell surfaces is then small, the shell surface of low bulk.

The visual impact of the inventive device is better if the fold of the waistband is covered by the holder. To ensure this, it is proposed to provide an exterior shell surface of the holder so long that it reaches further down on the waistband than the clip. To that end, this shell surface must have a larger vertical extension than the clip.

To guarantee the optimum wear comfort of the inventive device, the extension of a clip perpendicularly to the waistband should be as small as possible. This can be achieved with the maximum possible shortening of the waistband if the distance between the exterior sides of the two plates is even smaller than the extension of the plates in the longitudinal direction of the waistband, that is, the clip has a longish design in the direction of the waistband. Preferably, the distance between the exterior sides of the plates should be less than half the extension in the direction of the waistband.

BRIEF DESCRIPTION OF THE DRAWING FIGURES

In the drawing, wherein similar reference numerals denote similar features throughout the several views.

DETAILED DESCRIPTION OF THE DRAWING AND PREFERRED EMBODIMENTS

Figure 1:
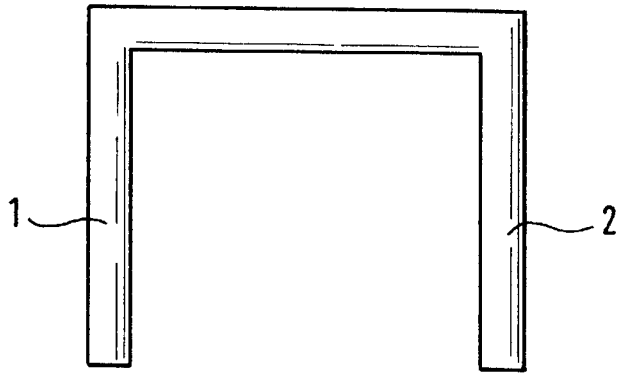
FIG. 1 is an elevational view of a simple clip.

FIG. 1 shows a view of a simple clip, which consists of two limbs (1, 2), which are connected to each other via the top side.

Figure 2:
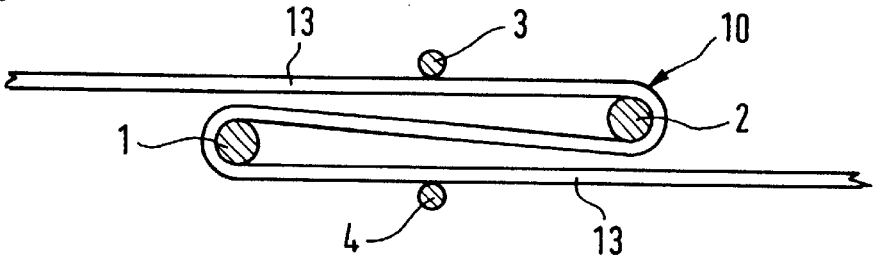
FIG. 2 is a schematic view of a horizontal section through a clip with the fold of a waistband.

FIG. 2 shows the arrangement of such a clip in the waistband (10) in a horizontal section. Waistband (10) is guided, S-shaped, around the two limbs (1, 2). The outside flanks (13) of the fold of waistband (10) are supported by means of arms (3, 4).

Figure 3:
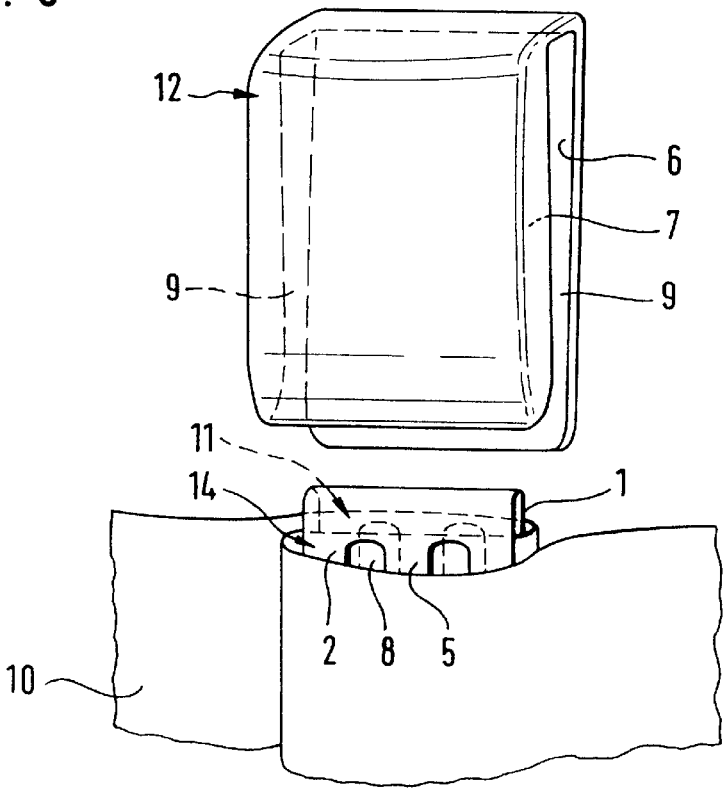
FIG. 3 is a perspective exploded view of a clip comprising two plates with a holder on the waistband.

FIG. 3 shows an embodiment of the invention in an exploded view. Limbs (2, 5) of the clip form a total of two plates (11). Between limbs (2, 5) of plate (11), there are slots (8), which in this case, however, are not used. Waistband (10) extends first along the exterior side of one plate (11), then between plates (11, 14), and finally along the exterior side of the other plate (14). A holder (12), which comprises two shell surfaces (6, 7), is guided over the clip. The shell surface (6) located inside waistband (10) is embodied as a plate. The two shell surfaces (6, 7) are connected to each other on the top side and run toward each other in the direction of the apertures (9).

Figure 4:
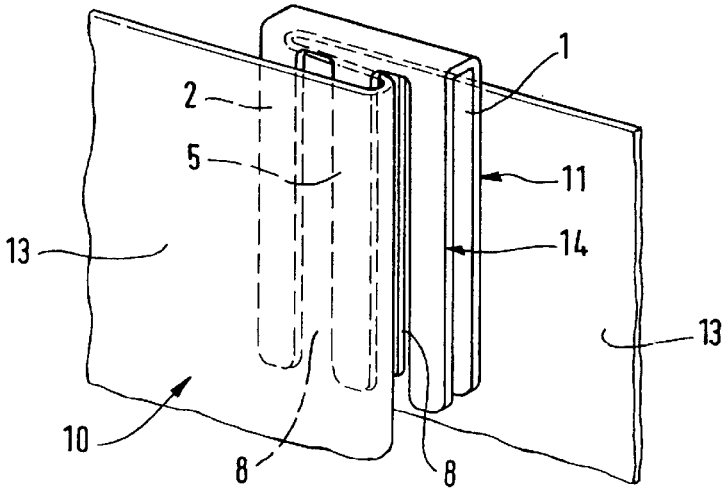
FIG. 4 is a perspective view of a similar clip with a somewhat different arrangement of the waistband.

FIG. 4 shows a lateral view, similar to that in FIG. 3, a clip and the piece of waistband (10) disposed around it. Only here, waistband (10) is guided through a slot (8). The shortening of the waistband is therefore smaller. The holder is not shown in this figure.

Figure 5:
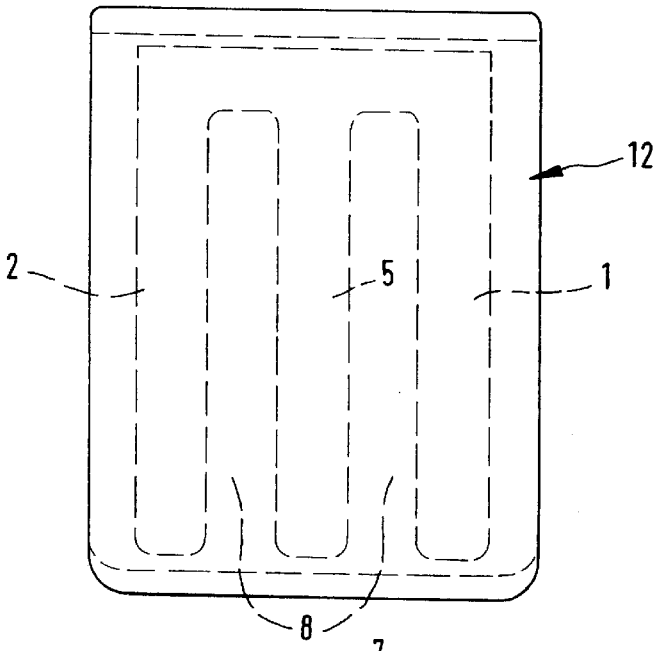
FIG. 5 is a schematic elevational view of the holder encompassing the entire U-shaped clip; and, FIG. 6 is a schematic view of a horizontal cross-section of the invention wherein the distance between the shell surfaces of the holder decreases near the apertures thereof.

FIG. 5 shows holder (12) encompassing the entire U-shaped clip having limbs (1, 2, 5) and slots (8).

Figure 6:
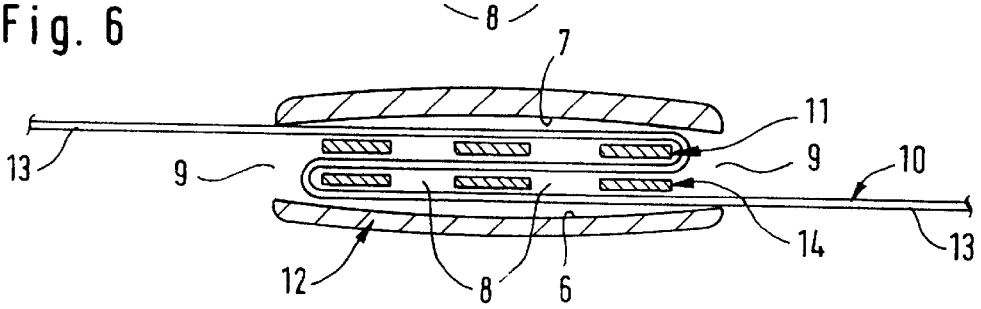

FIG. 6 is a schematic view of a horizontal cross-section of a preferred embodiment of the invention wherein the distance between the shell surfaces (6, 7) of the holder (12) decreases near the apertures (9) thereof.

What is claimed is:

1. An apparatus for adjusting the width of a waistband of a skirt or a pair of trousers, comprising:

a waistband of a skirt or a pair of trousers; and, a U-shaped clip slidable onto said waistband perpendicularly to a longitudinal direction of said waistband, said U-shaped clip comprising, at least, two limbs connected to one another on a top portion of each of said two limbs and arranged substantially parallel to one another, said waistband being arranged in a fold with said fold being formed by said waistband passing by said U-shaped clip, substantially parallel thereto, said waistband looping around a first limb of said two limbs before running back in an opposite direction, between said two limbs of said U-shaped clip, to a second limb of said two limbs, with said waistband looping around said second limb before being guided backward in the opposite direction, each side of said U-shaped clip having an arm extending vertically with said arms being provided substantially in a plane defined by said U-shaped clip and fitted on an outside flank of said fold of said waistband on a side facing away from said U-shaped clip, with said arms being limbs of a clasp and said clasp encompassing two outside flanks of said fold in close proximity of said U-shaped clip.

2. The apparatus for adjusting the width of a waistband of a skirt or a pair of trousers according to claim 1, wherein, as least, one of said arms is integrally molded with said U-shaped clip.

3. The apparatus for adjusting the width of a waistband of a skirt or a pair of trousers according to claim 1, wherein all of said limbs of said U-shaped clip have substantially the same vertical length.

4. The apparatus for adjusting the width of a waistband of a skirt or a pair of trousers according to claim 1, wherein said arms are formed by a holder encompassing the entire said U-shaped clip, including said fold on both sides of the plane defined by said U-shaped clip, with said outside flanks being guided out of said holder, on opposing sides, through apertures.

5. The apparatus for adjusting the width of a waistband of a skirt or a pair of trousers according to claim 4, wherein said, at least, two limbs of said U-shaped clip are disposed so that said, at least, two limbs form two plates being parallel to each other, and having lateral limitation lines extending substantially vertically, in which said holder is comprised of two shell surfaces which are connected to one another on a top side, said shell surfaces being disposed across a length, which corresponds to, at least, an extension of said two plates in a longitudinal direction of said waistband, and substantially parallel to one another and parallel to said two plates, with an interior distance apart that is greater than the distance between the exterior surfaces of said two plates, plus a two-fold waistband thickness, but which is small than horizontal diagonals between said two plates, with an aperture extending between side edges of said two shell surfaces, respectively, so as to be slot-shaped and substantially vertical.

6. The apparatus for adjusting the width of a waistband of a skirt or a pair of trousers according to claim 5, wherein said shell surface located inside said waistband is substantially plated-shaped.

7. The apparatus for adjusting the width of a waist-band of a skirt or a pair of trousers according to claim 5, wherein a vertical extension of one of said shell surfaces, which is located outside of said waistband, is greater than a vertical extension of said U-shaped clip.

8. The apparatus for adjusting the width of a waistband of a skirt or a pair of trousers according to claim 5, wherein said distance between said shell surfaces toward said apertures decreases.

9. The apparatus for adjusting the width of a waistband of a skirt or a pair of trousers according to claim 8, wherein the width of said apertures is smaller than the distance between the exterior sides of said two plates.

10. The apparatus for adjusting the width of a waistband of a skirt or a pair of trousers according to claim 1, wherein said U-shaped clip has, at least, three limbs.

11. The apparatus for adjusting the width of a waistband of a skirt or a pair of trousers according to claim 10, wherein said three limbs of said U-shaped clip are disposed in a plane relative to one another.

12. The apparatus for adjusting the width of a waistband of a skirt or a pair of trousers according to claim 1, wherein said, at least, two limbs of said U-shaped clip are disposed so that said, at least, two limbs form two plates being parallel to each other, and having lateral limitation lines extending substantially vertically.

13. The apparatus for adjusting the width of a waistband of a skirt or a pair of trousers according to claim 12, wherein said two limbs of said U-shaped clip, which said waistband loops around, belong to different plates of said two plates, said waistband being guided between said limbs into an interior space of said two plates and said outside flanks of said fold run, respectively, proximate to exterior sides of said plates.

14. The apparatus for adjusting the width of a waistband of a skirt or a pair of trousers according to claim 12, wherein as least one of said two plates is formed by one of said limbs.

15. The apparatus for adjusting the width of a waistband of a skirt or a pair of trousers according to claim 12, wherein a distance between the exterior sides of said two plates is less than the extension of said two plates in the longitudinal direction of said waistband.

16. The apparatus for adjusting the width of a waistband of a skirt or a pair of trousers according to claim 12, wherein, at least, one of said two plates is subdivided by, at least, one vertical slot into several limbs and said waistband, in a region in which said waistband loops around one of said limbs, and is guided through one of said vertical slots.

17. The apparatus for adjusting the width of a waistband of a skirt or a pair of trousers according to claim 16, wherein, said two plates are both subdivided, respectively, into said several limbs.

18. The apparatus for adjusting the width of a waistband of a skirt or a pair of trousers according to claim 16, wherein said several limbs are disposed on, at least, one of said plates, so as to be equidistant.

* * * * *